US012686047B2

(12) United States Patent
Hirt et al.

(10) Patent No.: US 12,686,047 B2
(45) Date of Patent: Jul. 21, 2026

(54) SEAMING SHAFT ARRANGEMENT FOR A SEALER

(71) Applicant: FERRUM PACKAGING AG, Schafisheim (CH)

(72) Inventors: Pascal Hirt, Aarau Rohr (CH); Alex Niederberger, Sins (CH)

(73) Assignee: FERRUM PACKAGING AG, Schafisheim (CH)

( * ) Notice: Subject to any disclaimer, the term of this patent is extended or adjusted under 35 U.S.C. 154(b) by 227 days.

(21) Appl. No.: 18/025,173

(22) PCT Filed: Sep. 21, 2020

(86) PCT No.: PCT/EP2020/076267
§ 371 (c)(1),
(2) Date: Mar. 7, 2023

(87) PCT Pub. No.: WO2022/058032
PCT Pub. Date: Mar. 24, 2022

(65) Prior Publication Data

US 2024/0024944 A1 Jan. 25, 2024

(51) Int. Cl.
*B21D 51/26* (2006.01)
*B21D 51/32* (2006.01)

(52) U.S. Cl.
CPC ..... *B21D 51/2653* (2013.01); *B21D 51/32* (2013.01)

(58) Field of Classification Search
CPC ..... B21D 51/2653; B21D 51/30; B21D 51/32
See application file for complete search history.

(56) References Cited

U.S. PATENT DOCUMENTS 3,006,304 A 10/1961 Renzi
4,092,940 A 6/1978 Wu et al.
5,375,394 A * 12/1994 Heudecker ..... B67B 3/12 53/368
11,253,905 B2 2/2022 Bratsch
(Continued)

FOREIGN PATENT DOCUMENTS

CN 204486642 U 7/2015
CN 206652909 U 11/2017
(Continued)

OTHER PUBLICATIONS

International Search Report and Written Opinion issued Jun. 11, 2021 in corresponding International Application No. PCT/EP2020/076267.

*Primary Examiner* — Debra M Sullivan
(74) *Attorney, Agent, or Firm* — Spencer Fane, LLP

(57) ABSTRACT

A seaming shaft arrangement for a sealer for attaching a can lid to a can body. The seaming shaft arrangement includes a seaming head, an ejection rod, an ejection head arranged on the ejection rod and movable with the ejection rod relative to the seaming, and a spring assembly by which the ejection head is resiliently mounted on the ejection rod. The spring assembly includes a slider arranged movably in the axial direction on the ejection rod, and a first elastic element arranged between a first abutment surface of the slider and a first supporting surface of the ejection rod, and a second elastic element arranged between a second abutment surface of the slider and a second supporting surface of the ejection head.

19 Claims, 6 Drawing Sheets

(56) References Cited

U.S. PATENT DOCUMENTS

| | | | | |
|---|---|---|---|---|
| 2002/0081172 | A1* | 6/2002 | Wu | B21D 51/30<br>413/27 |
| 2019/0240718 | A1 | 8/2019 | Bratsch | |

FOREIGN PATENT DOCUMENTS

| | | | |
|---|---|---|---|
| CN | 107635689 | A | 1/2018 |
| CN | 111268608 | A | 6/2020 |
| DE | 749636 | | 11/1944 |
| DE | 1878413 | U | 8/1963 |
| DE | 4234115 | A1 | 5/1993 |
| EP | 3520924 | A1 | 7/2019 |
| FR | 2269489 | A1 | 11/1975 |

* cited by examiner

SEAMING SHAFT ARRANGEMENT FOR A SEALER

CROSS-REFERENCE TO RELATED APPLICATION

This application is a U.S. National Stage application of International Application No. PCT/EP2020/076267, filed Sep. 21, 2020, the contents of which is hereby incorporated by reference.

BACKGROUND

Technical Field

The disclosure relates to a seaming shaft arrangement for a sealer. The disclosure further relates to a sealer and a seaming station having a seaming shaft arrangement according to the disclosure, a spring assembly for a seaming shaft arrangement according to the disclosure, and a method for sealing a can.

Background Information

When filling conventional beverage cans or food cans, the cans pass through a can sealer after being filled with the beverage or food, wherein the filled can bodies enter via a feed path and can lids (also lids) enter via a further feed path. The can sealer usually has several similar stations arranged in a carousel shape (hereinafter also carousel), in each of which a can body is sealed with a can lid. The can lids are guided onto the can bodies and held on the can body by an ejection head arranged on a seaming head. This holding by the ejection head only takes place during a rise of the can (composite of can body and can lid). After the can is clamped in the seaming head, the ejection head is no longer engaged for the time being. The can bodies are seamed with the can lid over a seaming roller at the edges and thus sealed in the can sealer. Normally, the can body with the can lid is additionally rotated around its own axis of symmetry by means of the seaming head. For rotation, the seaming rollers and seaming heads are arranged on a respective seaming shaft.

In DE 749636 and DE 4234115 A1, a generic can sealer is described. The can sealer comprises a clamping device for receiving a can to be sealed. In the operating state, the can to be sealed is introduced into the clamping device and secured by it in the axial direction and at an upper end radially (by the seaming head). A can lid is also introduced centered over the can opening of the can body to be sealed. In the region of the can opening, the can body has a circumferential can flange and the can lid has a circumferential can lid flange. For sealing the can opening with the can lid, the can sealer additionally comprises two seaming rollers, each mounted rotatably about an axis, which press the can flange and the can lid flange together by a force acting substantially radially, the pressing being effected by a continuous rolling in the circumferential direction along the circumference of the can opening.

In the case of conventional sealers, the ejection plate can be located at least partially within the seaming head and is movable relative to the seaming head in a vertical direction. When seaming the can lid to the can body, the cans usually run in the carousel of the sealer abound an axis of rotation. The units consisting of the seaming head and, as a rule, two seaming rollers are arranged on a circumference of the carousel. Usually, the sealer comprises a plurality of these units. During rotation of the carousel, the can lid is placed on the can body, the filled can body with the lid is lifted against the seaming head and sealed. Subsequently, the sealed can is lowered again and removed from the seaming head.

SUMMARY

It has been determined that depending on the working speed, relatively high centrifugal forces are generated which can throw the can outwards and can lead to interruptions in machine operation. This can be avoided by the ejection heads, which follow the lifting movement and/or the lowering movement of the can and, by exerting a force on the can, preferably on the can lid, during the lifting/lowering, generate a frictional force, which (between can and a seaming plate, which is obtained by the holding-down force (of an ejection head) and then by a lifting spring) counteracts the centrifugal force.

This force is preferably defined by a predetermined, adjusted stroke of the ejection head (e.g., by a cam-controlled position of the lifting station and the ejection head). This means that a controlled holding-down of the lid and body takes place before, during and/or after the seaming process.

Even in the case of slight deviations of the can or lid dimensions from the dimensions used as a basis for the adjusted stroke, damage can result, as the can buckle if it is not centered accurately when it enters/rises into the seaming head (i.e., if a force on the can is too great because the can is not centered correctly). If the force exerted by the ejection head is too small, this can result in insufficient fixation of the can, which can lead to the inaccurate centering. The cans therefore tend to collapse, if they are not adequately held by the ejection head while rising.

From EP 3 520 924 A1, a conventional seaming shaft arrangement for a sealer for seaming a can lid to a can body is disclosed, which comprises a seaming head for fixing the can lid to the can body. In addition, the seaming shaft arrangement comprises an ejection rod and an ejection head arranged on the ejection rod. In this case, the ejection head with the ejection rod is movable relative to the seaming head in an axial direction of the ejection rod. The ejection head comprises a spring assembly by which the ejection head is resiliently mounted on the ejection rod. As a result, a force determined by a spring force of the spring assembly is exerted on the can lid.

It has been determined that problems with process reliability due to "undefined" conditions (in particular an inconstant, undefined force so that the can is not reliably held) are to be avoided. No specific force adjustment is possible, which results in not being able to set the holding-down forces correctly due to manufacturing, cover and can tolerances. Uneven holding-down forces occur, which lead to the fact that the can cannot be held reliably on the seaming plate during the rise. Thus, the cans enter the seaming head unsteadily/eccentrically and are "force-centered" by the seaming head. This creates high forces/stresses in the can body, which can lead to the collapsing of the can.

It is therefore an object of the disclosure to provide a seaming shaft arrangement for a sealer and a seaming station, in particular a spring assembly for a seaming shaft arrangement according to the disclosure, which avoids the disadvantageous effects known from the state of the art. In particular, a seaming shaft arrangement and a sealer are to be provided, by which damage to the cans is largely avoided.

The object is met by a seaming shaft arrangement according to the disclosure, a spring assembly for the seaming shaft arrangement according to the disclosure, and a sealer and a seaming station with the seaming shaft arrangement according to the disclosure and by the method according to the disclosure.

According to the disclosure, a seaming shaft arrangement for a sealer for attaching (in particular seaming) a can lid to a can body is proposed, comprising a seaming head for fixing the can lid on the can body. The seaming shaft arrangement additionally comprises an ejection rod and an ejection head arranged on the ejection rod. The ejection head is movable with the ejection rod relative to the seaming head in an axial direction of the ejection rod. The seaming shaft arrangement further comprises a spring assembly by means of which the ejection head is resiliently mounted on the ejection rod.

The seaming shaft arrangement according to the disclosure is characterized in that the spring assembly comprises a slider which is arranged movably in the axial direction on the ejection rod. In addition, the spring assembly comprises a first elastic element arranged between a first abutment surface of the slider and a first supporting surface of the ejection rod, and a second elastic element arranged between a second abutment surface of the slider and a second supporting surface of the ejection head. In this embodiment, the slider can be supported on the ejection head in such a way that the ejection head can be resiliently mounted on the ejection rod via the first elastic element (or is mounted depending on an operating state).

Preferably, the ejection head is movably attached/arranged at one end of the ejection rod, whereby in particular first the spring assembly is arranged at the end of the ejection rod and then the ejection head, so that the ejection head is resiliently mounted via the spring assembly at the end of the ejection rod.

Due to the slider according to the disclosure with the two elastic elements, the seaming shaft arrangement according to the disclosure has in particular the advantage compared to the state of the art that a staggered force transmission for a centered fixing of can lid and/or can body is possible. The can lid can preferably first be applied with a second spring force of the second elastic element (which preferably serves to "guide" the can lid with a slight force in the region of a lid guide) and then be applied with a first spring force of the first elastic element in order to hold the can in place when it rises, so that it remains centered until the can enters the seaming head. The slider is supported on the ejection head (or a part of the ejection head) in such a way that the ejection head is resiliently mounted on the ejection rod via the first elastic element (i.e., by movement of the slider in the axial direction to the ejection head or by movement of the ejection head in the axial direction to the slider, e.g., when approaching the can).

Thus, in comparison to EP 3 520 924 A1, and in particular due to the slider according to the disclosure, a better force distribution is enabled (holding-down forces can thus be correctly defined to enable uniform holding-down forces), whereby damage such as buckling of the can when entering the seaming head due to insufficient centering of the can be prevented. Furthermore, a process reliability of the machine can be increased.

In an embodiment of the disclosure, the seaming shaft arrangement can further comprise a seaming shaft on which the seaming head is arranged (and by which the seaming head can be rotated). Both the ejection rod and the ejection head can be arranged at least partially in an interior of the seaming shaft and/or the seaming head, whereby they are movable relative to the seaming head and/or the seaming shaft in the axial direction (and whereby at least the ejection head can also be moved out of the interior). In this embodiment, the ejection head together with the ejection rod can also be resiliently mounted on the seaming shaft (as known in the state of the art).

Preferably, the slider can be supported on the ejection head in such a way that the ejection head is resiliently mounted on the ejection rod exclusively via the first elastic element, as a force between the can and the seaming shaft arrangement is transmitted via the ejection head to the slider and then to the first elastic element (and no longer via the second elastic element to the slider and then to the first elastic element).

In a particularly preferred embodiment of the disclosure, the ejection head can comprise an attachment element and an ejection element. The ejection element is movably attached to the ejection rod via the attachment element. The ejection element and the attachment element are firmly screwed together, in particular by a thread. In principle, the ejection element can be designed as a block or preferably as an ejection plate, which comes into contact with the can body via the can lid in the operating state. If the ejection head comprises the attachment element, forces can be transmitted from/via the attachment element (in particular directly) to the slider, as the slider can then be supported on the ejection head via the attachment element (depending on the compression of the second elastic element).

Instead of an ejection block screwed directly onto the ejection rod, the ejection head is fitted with a spring assembly as a resilient module and preferably with the ejection plate screwed on (also ejection pad). The aforementioned spring assembly does not need to be replaced in the case of a format change. In the case of format changes, only the ejection plate (which can be made of stainless steel, for example) screwed onto the lower end of the spring assembly can in particular be replaced.

In practice, the first elastic element can be a first spring, in particular a first spiral spring, and/or the second elastic element can be a second spring, in particular a second spiral spring. In addition, a first spring force of 70-160 N, in particular 80-150 N, can be transmitted to the ejection head by the first elastic element (in the operating state). In addition, a second spring force of 5-30 N, in particular 10-20 N, can be transmitted to the ejection head by the second elastic element (in the operating state). Thus, the spring assembly acts particularly preferably in two stages with different spring rates and preload forces. In a particularly preferred embodiment, the adjustment for different lid formats can be carried out with a first stage (second elastic element) with approx. 10-20N and a spring travel of up to 1 mm. Due to a flat spring characteristic with only approx. 1 N/mm, the acting force changes only slightly over the defined spring travel. In particular, this results in a predefined, uniform clamping force on the lid. As long as a holding-down height is within the range of the spring travel of the second elastic element, a lid geometry no longer has any influence.

As soon as the first stage has completed its full spring travel or until the first stage has completed a predeterminable spring travel (by a compression of the second elastic element and by supporting the slider), the ejection head can transmit forces (in particular, directly) to the slider, since the slider is then supported on the ejection head.

Due to the support of the slider, the first elastic element is then active (in particular, exclusively) and presses against a stroke direction of the can. What was done in the state of the art by means of a cam-controlled position of a lifting station and the ejection block should, by means of a spring assembly, result in a controlled and definable force when the can is clamped between the components mentioned.

The first elastic element is preferably significantly more preloaded and, depending in particular on the element used, acts between 80-150N over a spring travel of up to 2 mm. Thus, a reliable centering of the can during the rise to the seaming head can be achieved, so that buckling of cans can be prevented by the seaming head, even for cans with a thinner can material.

Particularly preferably, the slider can be designed as a sleeve which is arranged around the second elastic element. As an alternative or additionally, the slider can be designed as a sleeve which is arranged between the second elastic element and the ejection rod.

The first elastic element and the second elastic element are preferably arranged with respect to the axial direction on different sides of the slider, in particular on different sides of a circumferential projection of the slider. Here, the first and the second abutment surface can be arranged substantially parallel to each other and, especially, also orthogonal to the axial direction.

The attachment element can comprise an attachment jacket which is arranged (at least partially) around the ejection rod, the slider, the first elastic element and the second elastic element, wherein the attachment jacket comprises a projection on which the slider can be supported in such a way that the ejection head (in particular, exclusively) is resiliently mounted on the ejection rod via the first elastic element.

In practice, the attachment element can be arranged (attached) to the ejection rod, in particular by a screw connection or clamp connection, wherein the attachment element is preferably arranged movably in the axial direction via a sliding bush. Preferably, a clamp screw is used which is inserted into a corresponding thread on the ejection rod for arranging. However, the attachment element is not firmly screwed to the ejection rod. This sliding bush, which is located between the ejection rod and the screw connection, can move the entire spring travel (of the first and second elastic elements) on the sliding surface of the attachment element. This sliding surface is delimited in particular by the screw connection on a first side and by the ejection rod and/or the preload sleeve on the other side, so that the movement of the attachment element is also delimited. Then, the ejection plate can be screwed, clamped, or attached with a bolt/pin to the attachment element.

The ejection rod can comprise a preload sleeve which is attached to the ejection rod and comprises a projection by which a path of the slider (in particular when the slider is the sleeve) in the axial direction is delimited via the preload sleeve. In this way, the spring travel of the first elastic element can be delimited by the preload sleeve so that the slider cannot be moved further towards the end of the ejection rod. This means that a preload shoulder is formed by the preload sleeve on which the slider can rest.

According to another embodiment, the ejection element can be rotatably arranged about an axis of rotation extending along the axial direction (X) opposite the attachment element. In this way, rotation relative to the attachment element or relative to the ejection rod can be achieved during the sealing process.

The first supporting surface on which the first elastic element is supported on the ejection rod can be designed as a step, in particular as a disk arranged between the step and the first elastic element.

In addition, the seaming shaft arrangement according to the disclosure can comprise a first seaming roller and, in particular, a second seaming roller for seaming the can lid to the can body. In addition, the seaming shaft arrangement can comprise a lifting element, wherein the can body with the can lid is arranged between the lifting element and the seaming head during a seaming process, in particular is arranged between the lifting element and the ejection head.

According to the disclosure, a sealer for sealing a can comprising a seaming shaft arrangement according to the disclosure is further proposed. Thus, the sealer is particularly preferably a can sealer. In this embodiment, the sealer according to the disclosure can comprise a carousel with a plurality of seaming shaft arrangements according to the disclosure, and a first infeed for can bodies, in particular can bodies filled with a product, to the carousel and a second infeed for can lids to the carousel. In addition, the sealer can comprise an outlet for seamed cans from the carousel.

The can sealer (or the seaming shaft arrangement) preferably comprises one or more seaming rollers for sealing the can (as known from the state of the art). In the operating state, the seaming rollers with their respective seaming profile are brought into contact with the can lid flange of the can lid and the can flange of the can. By rotating the can, the seaming roller is then rotated in the circumferential direction of the can, whereby the can flange is seamed to the can lid flange. To rotate the can, the can is preferably clamped between the seaming head (or ejection head) and a support (in particular the lifting element), whereby the seaming head is rotated around the seaming axis (which extends in particular parallel to the axial direction) with the seaming shaft.

Within the framework of the disclosure, the can be understood to be a rotationally symmetrical container which is sealed by the can sealer and the associated seaming roller. A can preferably comprise plastic, cardboard, or a metal, in particular aluminum or steel.

In principle, the sealer according to the disclosure can be analogous to the can sealers already known from the state of the art but differs in the seaming shaft arrangement and the spring assembly, respectively. This has the advantage that the known can sealers/sealers can be modified with the seaming shaft arrangement according to the disclosure to avoid the disadvantages of the state of the art in this way.

In practice, as in the state of the art, the can sealer comprises a clamping device including a seaming head and a lifting element with which the can is fixed in axial and radial direction for sealing and can be rotated in the circumferential direction.

In principle, the sealer can preferably comprise at least two seaming rollers, preferably with different seaming profiles, so that cans can be sealed according to a double seaming principle in which the cans are generally sealed in two stages. One seaming roller is responsible for one stage.

According to the disclosure, a method for attaching a can lid to a can body is further proposed. In the method according to the disclosure, a seaming shaft arrangement according to the disclosure is provided. The can lid and the can body are fed to the seaming shaft arrangement. The can lid is positioned on the can body and the can body is positioned on the lifting element. A spring force is exerted on the can lid by the resiliently arranged ejection head until the can together with the loosely fitted lid is pressed into the seaming head by the lifting movement of the lifting element (while maintaining the spring force). Then, the can lid is seamed to the can body by at least one seaming roller. During the seaming process, the ejection head is not (no longer) engaged. Finally, the can is discharged from the seaming shaft arrangement.

If the method according to the disclosure is carried out with a sealer according to the disclosure, the can lid and the can body can be brought together at a defined point before the actual seaming process. The feeding of the can lids is preferably carried out by a gassing rotor on which the can lids rest. The can bodies are fed by a container feeder. The can bodies pass from the container feeder to one of the respective lifting elements (which are integrated into the carousel). During one rotation of the carousel, the lifting elements preferably perform a cam-controlled lifting movement in order to feed the can bodies from below to the can lids and later to the seaming head.

After a certain lifting distance, the can body comes into contact with the can lid. To enable the composite of can body and can lid to make the rest of the rise together, the ejection heads (preferably the ejection elements) are used.

For example, the ejection head is attached to the ejection rod by a thread, which makes a linear movement along the axial direction inside a seaming shaft (the seaming head is attached to the seaming shaft). Preferably cam-controlled, during the downward movement, the can lid is first clamped in the lid feeder (by the second force of the second elastic element). As soon as the can body has entered the can lid, the ejection head changes the direction of the stroke and moves upwards evenly with the lifting element (whereby the can lid is fixed centered on the can body by the first force of the first elastic element). The supporting function of the ejection element ends when the can body and the can lid are inserted into the seaming head. From this moment on, the can is clamped between the lifting element and the seaming head. Subsequently, the actual seaming process is carried out.

BRIEF DESCRIPTION OF THE DRAWINGS

In the following, the disclosure and the state of the art are explained in more detail on the basis of embodiments with reference to the drawings.

DETAILED DESCRIPTION

Figure 1:
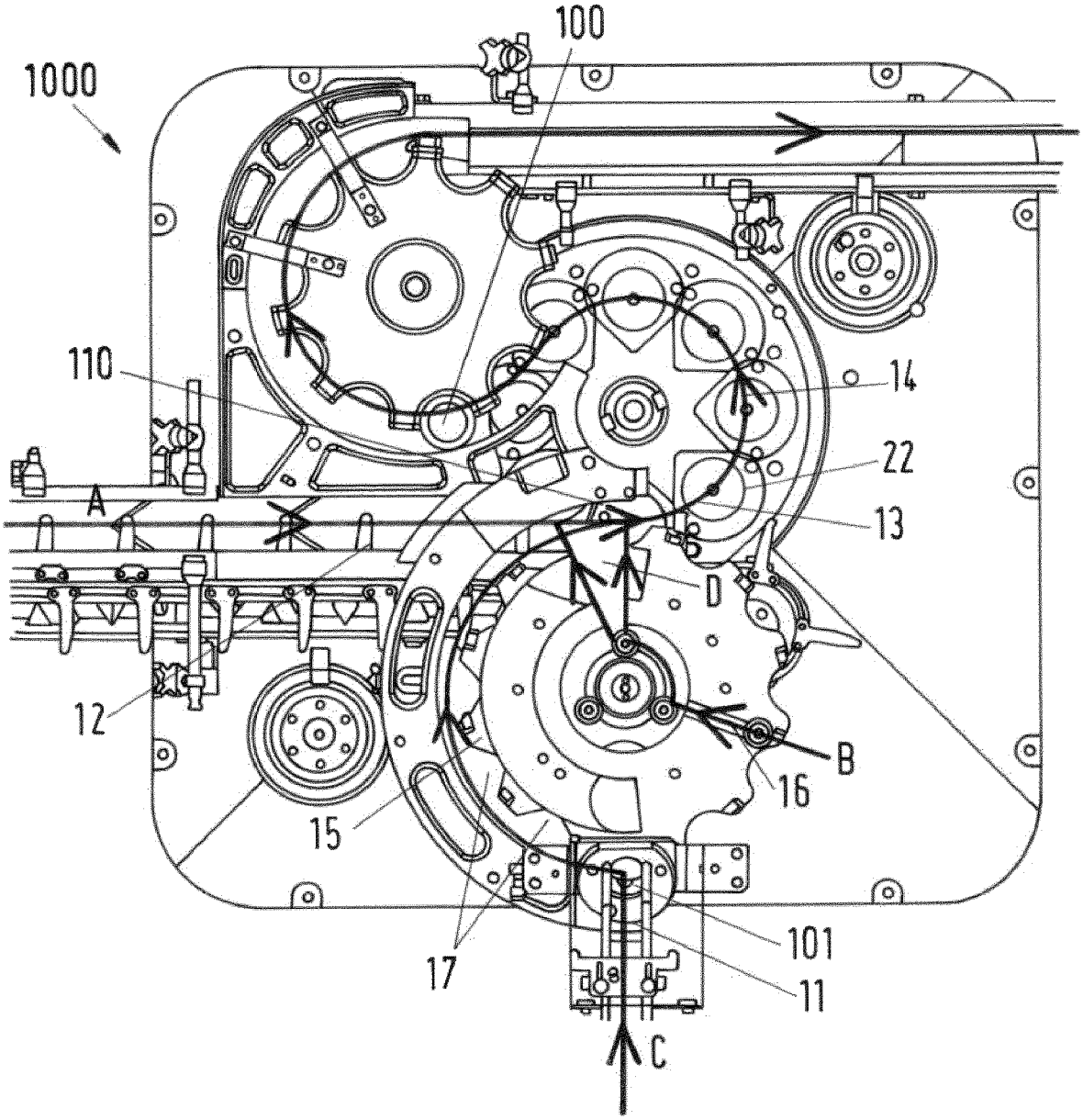
FIG. 1 is a plan view of a sealer according to the disclosure.

FIG. 1 shows a plan view of a sealer 1000 according to the disclosure.

The sealer 1000 for sealing a can comprises a lid feeder 11 for feeding a can lid 101 to a can body 100, a gassing rotor 15 for feeding gas to the can body 100, and a seaming station 14 for sealing the can body 100 with the can lid 101.

In the operating state, the can lid 101 is introduced along the arrow C through the lid feeder 11 into the sealer 1000. In this case, the can lids 101 are arranged on the gassing rotor 15. The can lids 101 are transported further by rotation of the gassing rotor 15. Then, the can bodies 100 are introduced into the container receptacles 17 of the gassing rotor 15 by the container feeder 12. There, the can body 100 is gassed with a gas such as carbon dioxide or nitrogen in area D and is united with the can lid 101.

The gassing is carried out along the arrow B with the gas supply 16. After gassing, the can body 100 with the cover 101 is further transported through the container discharge 13 from the gassing rotor 15 to the seaming station 14 and is sealed there.

Before the actual seaming process, can lid 101 and can body 100 are united as described above. The can bodies 100 are fed linearly via the container feeder 12. The can bodies pass from the container feeder 12 onto one of the respective lifting elements 22 of the seaming station 14, which is designed as a carousel (preferably arranged in the form of a vertical shaft). During one rotation of the carousel, the lifting elements 22 perform a cam-controlled lifting movement, whereby the can bodies 100 are guided from below against the can lids 101. After a certain stroke distance, the can body 100 and the can lid 101 touch each other.

To enable the remainder of the stroke to be performed together without interference, an ejection head according to the disclosure (not shown here), is used to clamp the can body 100 and can lid 101.

Figure 2:
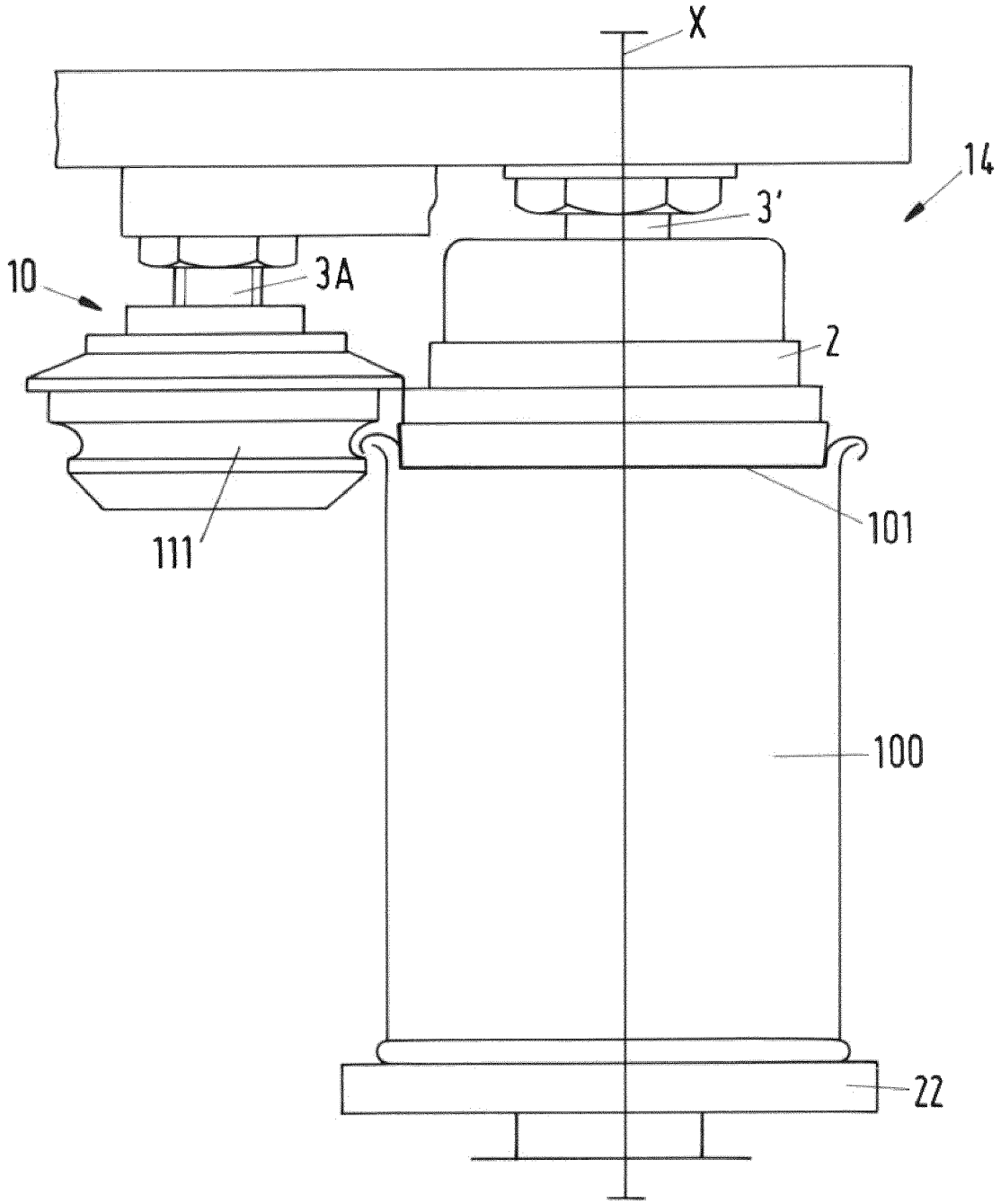
FIG. 2 is a side view of a seaming station.

FIG. 2 shows a side view of a seaming station 14 according to the disclosure with a can body 100 to be sealed and a can lid 101.

According to FIG. 2, the seaming station 14 comprises a clamping device which comprises the lifting element 22 and a seaming head 2, whereby the seaming head 2 is attached via the seaming shaft 3'. In addition, the seaming station 14 comprises at least one seaming roller 10 with a seaming roller profile 111 which is rotatably mounted via a roller shaft 3A. The can lid 101 is arranged centered above the opening of the can body 100. The can body 100 has a circumferential can flange in the region of the can opening, and the can lid 101 has a circumferential can lid flange.

During the sealing process, the seaming roller 10 is brought into contact with the can flange and the can lid flange via the seaming roller profile 111. Here, the can flange and the can lid flange are pressed together via the seaming roller 10 by a force acting substantially radially. The pressing is achieved by a continuous rolling of the seaming roller 10 in the circumferential direction along the circumference of the can opening.

For sealing, the can body 100 is rotated by the clamping device by rotating the seaming head 2 with the seaming shaft 3' about the seaming axis X (corresponds to an axial direction).

Figure 3A:
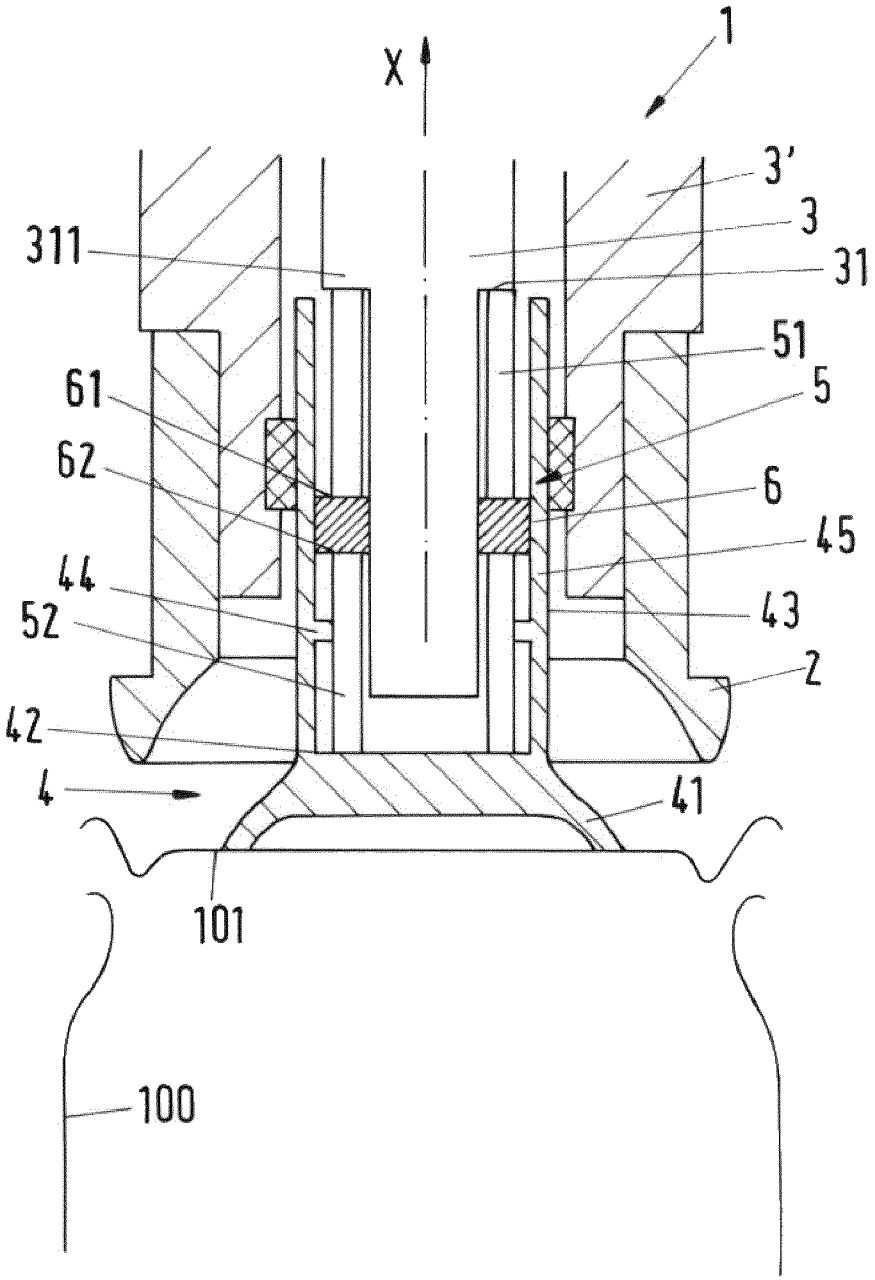
FIG. 3A is a sectional representation of a first embodiment of a seaming shaft arrangement according to the disclosure under the action of a second elastic element.
Figure 3B:
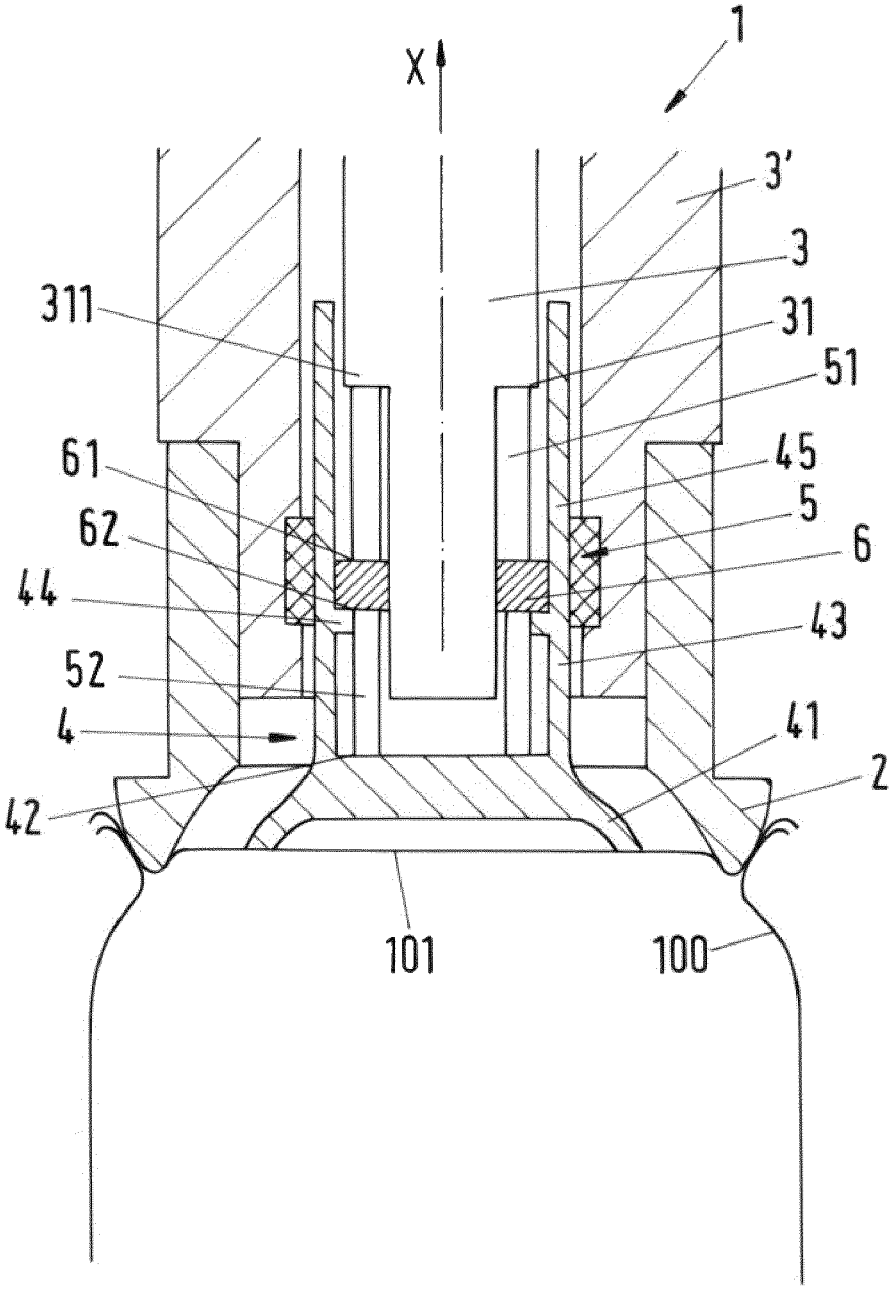
FIG. 3B is a further sectional representation of the embodiment according to FIG. 3A under the action of a first elastic element.

FIGS. 3A and 3B show sectional representations of a first embodiment of a seaming shaft arrangement 1 according to the disclosure.

The seaming shaft arrangement 1 comprises the seaming head 2, which is arranged on the seaming shaft 3', and an ejection rod 3, and the ejection head 4 arranged on the ejection rod 3 and movable with the ejection rod 3 relative to the seaming head 2 (and the seaming shaft 3') in an axial direction X of the ejection rod 3. The ejection rod 3 is movably arranged substantially inside the seaming head 2 (and seaming shaft 3').

The seaming shaft arrangement 1 further comprises a spring assembly 5 by which the ejection head 4 is resiliently mounted on the ejection rod 3.

The spring assembly 5 comprises a slider 6 arranged movably in the axial direction X on the ejection rod 3, and a first elastic element 51 arranged between a first abutment surface 61 of the slider 6 and a first supporting surface 31 of the ejection rod 3. In addition, the spring assembly 5 comprises a second elastic element 52 arranged between a second abutment surface 62 of the slider 6 and a second supporting surface 42 of the ejection head 4.

According to the disclosure, the slider 6 can be supported on the ejection head 4 in such a way (in an operating state) that the ejection head 4 is resiliently mounted on the ejection rod 3 exclusively via the first elastic element 51.

In the embodiment shown, the first elastic element 51 is a first spiral spring 51 and the second elastic element 52 is a second spiral spring 52.

The ejection head 4 comprises an attachment element 43 and an ejection element 41, which form an integral part. The ejection head 4 is movably arranged on the ejection rod 3 via the attachment element 43 (attachment not shown here).

The attachment element 43 has a jacket 45 which is arranged around the ejection rod 3, the slider 6, the first spiral spring 51 and the second spiral spring 52. The jacket 45 has a projection 44 directed towards the ejection rod 3, on which the slider 6 can be supported (on a slider supporting surface). This means that this projection 44 comprises the slider supporting surface. In this way, it is made possible that the ejection head 4 is resiliently mounted on the ejection rod 3 via the first spiral spring 51, since a force transmission between the first spiral spring 51 and the ejection element 41 takes place via the slider 6.

In this way, a staggered force transmission is possible, since when the can 100, 101 is approached, first a second spring force of 10-20 N (to hold the can lid 101 in a lid guide) is exerted by the second spiral spring 52, and then to fix the can lid 101 centered on the can body 100, a first spring force of 80-150 N can be exerted by the first spiral spring 51. Thus, the can lid 101 is held centered on the can body 100 by a defined, uniform force when it is raised to the seaming head 2, so that any buckling can be avoided when it is moved into the seaming head 2.

FIG. 3A shows the can lid 101 as it is held in a lid guide not shown. The lid 101 is applied with the second spring force of the second spring 52 by the ejection element 41. In this way, the lid 101 can be centered on the can body 100.

As soon as the can body 101 is introduced into the can lid 100, the ejection head 4 changes the direction of the stroke and moves upward uniformly with the lifting element (under the can 100, 101, not shown), whereby the can lid 101 is fixed centered on the can body 100 by the first force of the first elastic spring 51. For this purpose, the lid 101 is exclusively applied with the first spring force of the first spring 51 by the ejection element 41 and can thus enter the seaming head 2 centered with the can body 100. To ensure that only the first spring force acts, the slider 6 is supported on the projection 44 of the ejection head 4.

FIG. 3B shows the can lid 101 as it is arranged centered on the can body 100 and in engagement with the seaming head 2. From this moment on, the can 100, 101 is clamped between the lifting element (not shown) and the seaming head 2. Subsequently, the actual seaming process is carried out.

Figure 4:
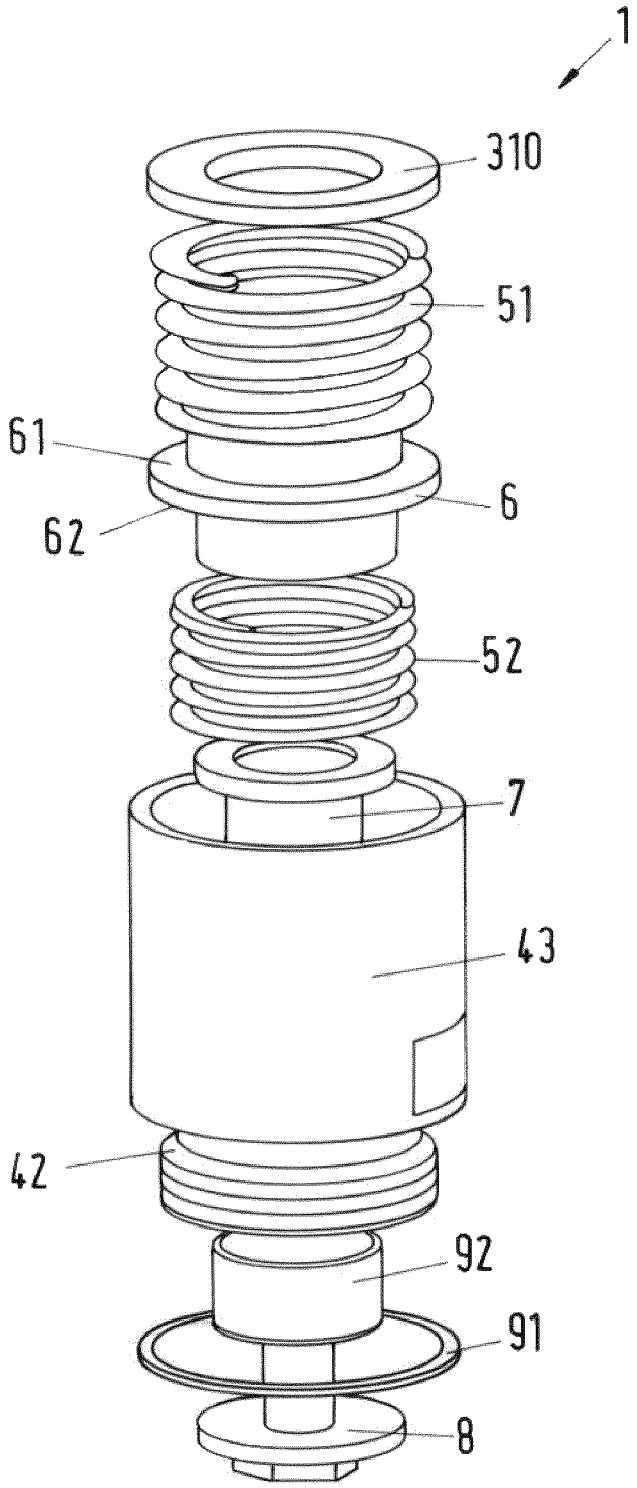
FIG. 4 is an exploded view of an ejection head according to the disclosure, in which a spring assembly according to the disclosure is additionally represented.

FIG. 4 shows an exploded view of the individual elements of the ejection head 4 according to the disclosure according to FIGS. 3A and B, in which the spring assembly according to the disclosure is represented in addition to the ejection head 4. However, the ejection head 4 is not shown in its entirety, as parts at the lower end, such as the ejection element, are not shown.

The first abutment surface 61 of the slider 6 and the second abutment surface 62 of the slider 6 are located on opposite sides of a circumferential ring of the slider 6.

An O-ring seals a joint between the ejection element 41 and the attachment element 43. A sliding bush (or sliding bearing) 92 is attached with a screw 8.

Thus, the attachment element 43 is not screwed tightly to the ejection rod 3 but is arranged movably thereon (via the sliding bush 92 which is delimited at the top as well as at the bottom, respectively at two sides with reference to the axial direction X, respectively). The movement of the attachment element 43 on the ejection rod 3 is delimited by the preload sleeve 7 and the screw 8. Thus, the attachment element 43 slides on the sliding bush 92.

On a sliding surface of the sliding bush 92, the attachment element can travel the entire spring travel (of the first and second elastic elements). This sliding surface is delimited by the screw 8 on a first side and by the preload sleeve 7 on the other side.

The first supporting surface is located on the disk 310, which is supported on a step 311 of the ejection rod as shown in FIG. 3.

Figure 5:
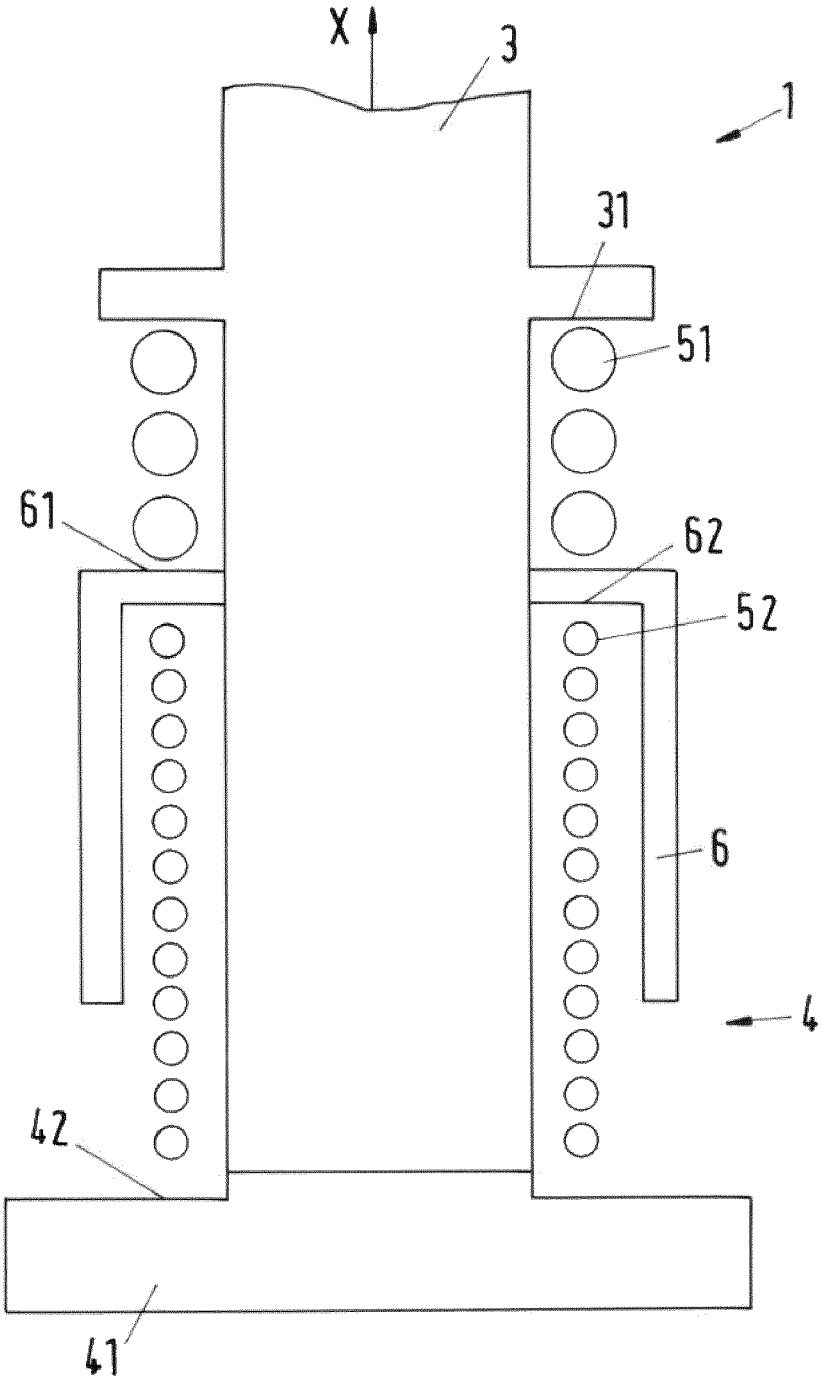
FIG. 5 is a schematic representation of a second embodiment of a seaming shaft arrangement according to the disclosure.

FIG. 5 shows a schematic representation of a second embodiment of a seaming shaft arrangement 1 according to the disclosure. Basically, the structure is analogous to the seaming shaft arrangement according to FIGS. 3A and B, but the slider 6 is a sleeve 6 which is arranged around the second spiral spring 52 and can transmit the first spring force directly to the ejection head 4 arranged movably on the ejection rod 3. The force transmission from the first spring 51 can take place when the sleeve 6 completely encloses the second spring 52 and is supported on the ejection element 41.

The invention claimed is:

1. A seaming shaft arrangement for a sealer for attaching a can lid to a can body comprising:

a seaming head configured to fix the can lid to the can body; and an ejection rod; and an ejection head arranged on the ejection rod and movable with the ejection rod relative to the seaming head in an axial direction of the ejection rod;

a spring assembly by which the ejection head is resiliently mounted on the ejection rod, the spring assembly comprising a slider arranged movably in the axial direction on the ejection rod, a first elastic element arranged between a first abutment surface of the slider and a first supporting surface of the ejection rod, and a second elastic element arranged between a second abutment surface of the slider and a second supporting surface of the ejection head, and the slider being configured to be supported on the ejection head such that the ejection head is resiliently mounted on the ejection rod via the first elastic element; and a seaming shaft on which the seaming head is arranged, the ejection rod and the ejection head arranged at least partially in an interior of the seaming shaft or the seaming head, whereby at least one of the seaming shaft or the seaming head are movable relative to an other of the seaming head or the seaming shaft in an axial direction.

2. The seaming shaft arrangement according to claim 1, wherein the slider is configured to be supported on the ejection head such that the ejection head is resiliently mounted on the ejection rod exclusively via the first elastic element.

3. The seaming shaft arrangement according to claim 1, wherein the slider is a sleeve which is arranged around the second elastic element.

4. The seaming shaft arrangement according to claim 1, wherein the slider is a sleeve which is arranged between the second elastic element and the ejection rod.

5. The seaming shaft arrangement according to claim 4 further comprising a preload sleeve attached to the ejection rod, the ejection rod comprising a projection by which a path of the slider in the axial direction is delimited via the preload sleeve.

6. The seaming shaft arrangement according to claim 1, wherein the first supporting surface is a step.

7. The seaming shaft arrangement according to claim 1, wherein the ejection head comprises an attachment element and an ejection element, and the ejection element is movably attached to the ejection rod via the attachment element.

8. The seaming shaft arrangement according to claim 7, wherein the attachment element comprises an attachment jacket arranged around the ejection rod, the slider, the first elastic element and the second elastic element, and the attachment jacket comprises a projection on which the slider is configured to be supported such that the ejection head is resiliently mounted on the ejection rod via the first elastic element.

9. The seaming shaft arrangement according to claim 7, wherein the attachment element is attached to the ejection rod.

10. The seaming shaft arrangement according claim 7, wherein the ejection element is rotatably arranged about an axis of rotation extending along the axial direction opposite the attachment element.

11. The seaming shaft arrangement according to claim 7, wherein the ejection element is firmly connected or screwed or clamped to the attachment element.

12. The seaming shaft arrangement according to claim 7, wherein the attachment element is movably arranged in the axial direction on a sliding bush arranged on the ejection rod.

13. The seaming shaft arrangement according to claim 1, wherein the first elastic element is a first spring, or the second elastic element is a second spring.

14. The seaming shaft arrangement according to claim 1, wherein the first elastic element is configured to transmit a first spring force of 70-160 N to the ejection head, and the second elastic element is configured to transmit a second spring force of 5-30 N to the ejection head.

15. The seaming station comprising a seaming shaft arrangement according to claim 1, further comprising a first seaming roller and a second seaming roller to attach the can lid to the can body.

16. The seaming station according to claim 15, further comprising a lifting element, and the lifting element and the seaming head are configured to have the can body with the can lid arranged therebetween during a seaming process.

17. A sealer comprising:

a carousel having the seaming shaft arrangement according to claim 1;

a first infeed to feed can bodies to the carousel;

a second infeed to feed can lids to the carousel; and an outlet for seamed cans from the carousel.

18. A method for attaching a can lid to a can body, comprising:

providing a seaming shaft arrangement according to claim 1;

feeding the can lid and the can body to the seaming shaft arrangement;

positioning the can lid on the can body;

positioning the can body on a lifting element;

exerting a spring force on the can lid with the ejection head;

seaming the can lid to the can body by at least one seaming roller and the seaming head;

synchronous lowering of the ejection head and the lifting element while maintaining the spring force on the can lid;

lifting of the ejection head from the can lid; and discharging the seamed can from the seaming shaft arrangement.

19. The method according to claim 18, wherein the can lid is guided by a second spring force in a region of a lid guide and is guided onto the can body, the can body and the can lid are lifted by the lifting element and, during lifting, a first spring force is exerted on the can lid by the ejection head, and during lifting, the first spring force is exerted on the can lid by supporting the slider on the ejection head such that the ejection head is resiliently mounted on the ejection rod via the first elastic element.

* * * * *